United States Patent [19]

Jorgensen

[11] 4,415,156

[45] Nov. 15, 1983

[54] MATCHED SET OF GOLF CLUBS

[76] Inventor: Theodore P. Jorgensen, 3455 L St., Lincoln, Nebr. 68510

[21] Appl. No.: 296,572

[22] Filed: Aug. 26, 1981

[51] Int. Cl.[3] ..... A63B 53/00

[52] U.S. Cl. ..... 273/77 A; 273/81 A

[58] Field of Search ..... 273/77 A

[56] References Cited

U.S. PATENT DOCUMENTS

| | | | |
|---|---|---|---|
| 1,594,801 | 8/1926 | Stackpole | 273/77 A |
| 1,953,916 | 4/1934 | Adams | 273/77 A |
| 3,473,370 | 10/1969 | Marciniak | 273/77 A |
| 3,698,239 | 10/1972 | Everett | 73/65 |
| 3,703,824 | 11/1972 | Osborne et al. | 73/65 |
| 4,058,312 | 11/1977 | Stuff et al. | 273/77 A |
| 4,128,242 | 12/1978 | Elkins, Jr. | 273/77 A |

*Primary Examiner*—George J. Marlo

*Attorney, Agent, or Firm*—Kinney, Lange, Braddock, Westman and Fairbairn

[57] ABSTRACT

The present invention relates to increasing the ability of a golfer to excel at the game. The invention comprises a correlated set of golf clubs in which each club of the set is dynamically correlated with every other club of the set so that each club has approximately the same overall mass, first moment about some wristcock axis, and second moment about the same axis. This correlation is achieved using a unique computation method for determining the mass distribution for each club of the set which distributes the mass of the club among its various elements, such as the club head, an added mass rigidly secured in the shaft at the midpoint between the center of mass of the club head and the wristcock axis at the grip, and a further mass positioned adjacent the wristcock axis.

14 Claims, 5 Drawing Figures

Table II Set of Matched Clubs

Table III Set of Matched Clubs

MATCHED SET OF GOLF CLUBS

BACKGROUND OF THE INVENTION

1. Field of the Invention

The present invention relates to golf clubs, and specifically to an improved method of dynamically matching a set of clubs.

2. Prior Art

Attempts to "match" a set of golf clubs are well known in the prior art. Basically, the art of matching golf clubs may be summarized in four categories:

1. Swing-weight matching. This method of matching, detailed in U.S. Pat. Nos. 1,594,801 and 1,953,916, is a static measurement technique to match a set of clubs. The "swing-weight" of a given club is determined by placing the club across a knife-edge or fulcrum located at an arbitrary fixed distance (usually 12 to 14 inches) from the grip end of the shaft and placing sufficient weight at the very tip of the grip end of the shaft to balance the club. This weight is then termed the "swing-weight". The swing-weight method of matching clubs assures a gradual variation of the dynamic parameters, the mass, the first moment, and the second moment (monent of inertia) of the clubs over the set of clubs. Most golf clubs now available to golfers are swing-weight matched.

2. First moment matching. U.S. Pat. No. 4,058,312 describes this method of matching a set of golf clubs and is based on the assumption that it is the first moment that determines the feel in the swing of a golf club and, therefore, a set of clubs with identical first moments will provide the golfer with better control. This patent describes a set of clubs matched according to their first moment about a wristcock axis at some standard distance from the grip end of the club.

3. Moment of inertia matching. Various methods for matching a set of clubs according to their moments of inertia are described in U.S. Pat. Nos. 3,703,824, 3,698,239, and 3,473,370. In essence, each of these methods strives to achieve the same moment of inertia about some wristcock axis for each club of a set. This moment of inertia method of matching is based on the assumption that it is the second moment (the moment of inertia) that determines the feel and the swing of a golf club and, therefore, clubs with identical second moments will provide the golfer with better control.

4. Mass, first moment, and second moment matching. A set of golf clubs are matched when the three dynamic parameters, the mass, first moment about some wristcock axis, and second moment about the same wristcock axis, are respectively the same for all clubs of the set. The first moment and second moment parameters are dependent on the distribution of mass in the club. One method of finding a distribution of mass for each club that will satisfy this criteria of matching is described in U.S. Pat. No. 4,128,242. This patent discloses a method for matching golf clubs in which a single mass slug is placed at some point, different for each club, along the shaft of each club. This method, while it does work to produce matched clubs, has several shortcomings. The theoretical discussion of matching in this patent separates the dynamic parameters of a golf club into two classes, the dynamic parameter (moment of inertia) and the static parameters (mass and first moment). The differential equations of motion of the swing of a golf club, which are the equations of a well-known double pendulum problem, show that indeed all three of these parameters must be considered as dynamic parameters.

In addition, the matching method disclosed in this patent does not give a unique solution to the matching formulation. To initiate the matching process as described in this patent, a single mass slug is placed at some point in the shaft of the club with the shortest shaft in the set. The determination of the mass of this single mass slug, as well as its location in the shaft of the club, is not disclosed in the patent. Further, the example provided in the patent employs clubs longer and slightly heavier than standard length golf clubs, presumably as a result of the inadequacies of the matching method disclosed.

With a set of golf clubs matched according to the present invention, these difficulties are alleviated. To achieve perfect matching, two quantities of mass are positioned rigidly in the shaft of each golf club according to the present invention. An added mass is positioned rigidly in the shaft at a point one-half the distance between the wristcock axis and the coordinate along the shaft of the center of mass of the club head, and a further mass is positioned in the shaft adjacent the wristcock axis. The positions and quantities of these masses are uniquely determined by the formulation described by the present invention. In addition, clubs of standard lengths may be matched according to the method of this invention. The present invention describes a method of matching golf clubs which overcomes the difficulties of the prior art, and will simplify the manufacture of such clubs in practice.

SUMMARY OF THE INVENTION

The present invention is a correlated set of more than two golf clubs and a method for producing the same in which the golf clubs have different lengths and each has a shaft with a grip having a preselected wristcock axis at one end and a club head having a center of mass at the other end. One of the golf clubs, having the desired characteristics for the user, is selected as a Master Club. All of the clubs except the Master Club have an added mass rigidly secured in the shaft of the club at a point one-half the distance between the wristcock axis of the grip and the center of mass of the club head. The value of this mass and that of the clubhead are determined so that, in spite of the difference in length, each of the clubs has substantially the same overall mass and the mass of the club head and the added mass at the midpoint are so computed such that each of the clubs has substantially the same first moment of inertia about the wristcock axis, and hence, essentially the same second moment of inertia about said wristcock axis. By adjustment of the values of the mass of the club head and the added mass, each of the dynamic parameters (mass, first moment, and second moment) of the remaining clubs of the set are correlated with those of the Master Club.

In one embodiment, each of the clubs in a matched set contains a further mass disposed adjacent the wristcock axis of that club. By incorporating this further mass, the matching computations can provide that each club of the set has the same overall mass, the same first moment of inertia about the wrist cock axis, and the same second moment of inertia about said wristcock axis.

Using a set of golf clubs matched according to the present invention, a golfer will be able to simplify his swing since it will be unnecessary to adjust the swing according to the club used. By matching the clubs according to their dynamic parameters, the golfer's swing will feel fundamentally the same to him, no matter which club he uses out of the matched set. The present invention computationally determines the unique mass distribution necessary for such a dynamic matching without the necessity for great deviation from the standard masses and lengths of golf clubs in present use.

DETAILED DESCRIPTION OF THE INVENTION

Figure 2:
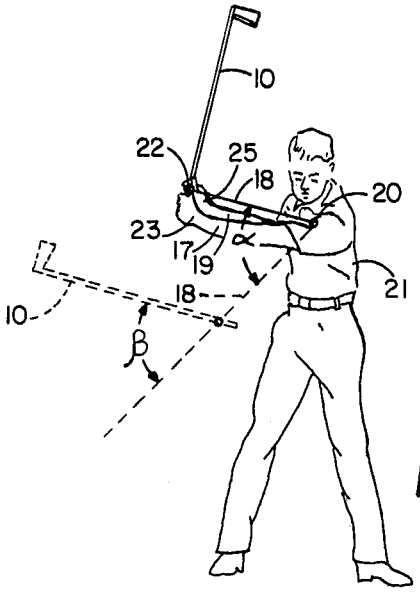
FIG. 2 illustrates a golfer in the process of a golf swing with notations identifying the relevant rotational angles.
Figure 1:
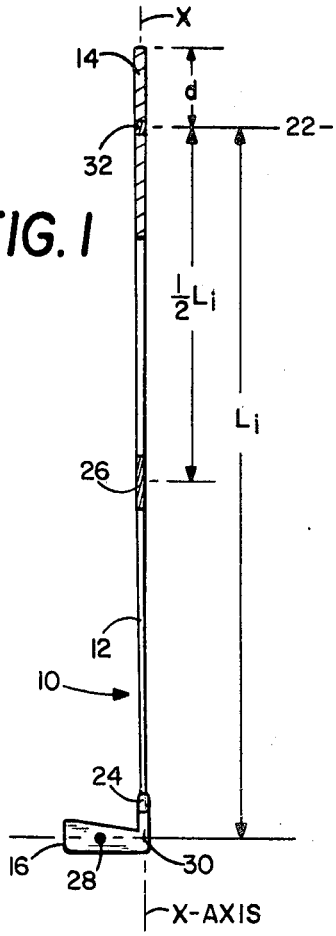
FIG. 1 illustrates a diagrammatic view of a golf club showing the parameters and relative club parts used in calculations according to the invention.

FIG. 1 illustrates a golf club 10, typically one of a set of irons, having a shaft 12, a grip 14 and a club head 16. A simplified but adequate theoretical model of the golf swing is given by two massive rods connected by a hinge and rotated about a horizontal axis as shown in FIG. 2. Rod 18 represents the golfer's arms 17, 19 and any additional parts of the golfer's body 21 involved in the swing while rod 10 represents the golf club. Rod 18 has a movement of inertia about the axis about which the arms swing, shown as axis 20. Rod 10 has a moment of inertia about an axis at 22, the axis about which the golfer breaks his wrists 23, 25, and a first moment about the same axis. In FIG. 1, axis 22 is shown adjacent the grip 14 of club 10. Axis 22 is the wristcock axis.

To discuss the unique method of matching a set of golf clubs as described by this invention, a system of notation is necessary. The total mass of the golf club may be represented by the letter M. The moment of inertia about the axis 20 may be represented by the letter J, the moment of inertia about the axis 22 by the letter I, and the first moment about axis 22 by the letter S. The length of rod 18 may be designated by the letter R. The angle of the golfer's arms 17, 19 (rod 18) in the down swing measured from the highest position in the back swing is indicated by $\alpha$. The wristcock angle between the golf club 10 and the extension of the golfer's arms 18 is indicated by $\beta$. If the torque applied by the golfer's body 21 to the system consisting of the golfer's arms 18 and the club 10 is indicated by $T_s$, and the torque applied to the golf club 10 by the golfer's wrists 23, 25 is indicated by $T_c$, then the differential equations of motion describing the system may be put in the form:

$$T_s = [J + I + MR^2 + 2RS\cos\beta]\ddot{\alpha} - [I + RS\cos\beta]\ddot{\beta} + [(\dot{\alpha} - \dot{\beta})^2 - \dot{\alpha}^2]RS\sin\beta$$

$$T_c = -1\ddot{\beta} + [I + RS\cos\beta]\ddot{\alpha} - \dot{\alpha}^2 RS\sin\beta$$

where the dotted letters refer to derivatives of the angles with respect to time.

While $T_s$ and $T_c$ are the torques applied by the golfer, according to Newton's Third Law of Motion the golfer has torques $-T_s$ and $-T_c$ acting on him, and these are the torques he feels during the swing. Besides these torques, the golfer will also feel forces, such as the centrifugal force on the club during the swing and the weight of the club. By examining the differential equations, it is seen that the torques depend on three parameters of the club: I (moment of inertia), S (first moment), and M (mass, which, of course, determines the club weight). For two golf clubs to be matched in the sense that they will produce the same torques and forces on the golfer, so that they will "feel" the same to him, it is necessary and sufficient that these three parameters (I, S and M) of one club be respectively the same as the corresponding three parameters of the other club, since it is only through these parameters that the characteristics of the club are present in the differential equations.

The scheme presently in general use for matching golf clubs, the swing-weight method, does not produce a set of clubs in which all of the clubs have the same mass, first moment, and second moment about the axis in the club about which the golfer breaks his wrists. The swing-weight of a club is defined by the first moment about an arbitrary point in the club; this point is usually chosen to be 12 inches from the grip end of the club. The swing weight of the club depends on a linear combination of S and M, previously defined, of the form S-nM, where the quantity n, a constant, depends on the system of units used, and does not depend on the moment of inertia I in any direct way. A set of golf clubs matched by the swing-weight method will thus have all three parameters I, S, and M, varying from club to club. A particular set of professional quality clubs was found to have variations in these parameters of 4.0, 5.8, and 15.0 percent respectively. Golf clubs matched by swing weight cannot be considered to be matched in the new sense described by this invention.

The first indication that a set of golf clubs can indeed be matched perfectly comes from the observation that mass placed at the wristcock axis 22 in the shaft 12 of the club 10 will have no effect on the first and second moments of the club about that axis and that the ratio I/S of a physical pendulum depends on the mass distribution in the pendulum. The period T of a physical pendulum is given by the expression:

$$T = 2\pi\sqrt{\frac{I}{gS}}$$

where g is the acceleration due to gravity. In a given physical pendulum, as mass is moved toward the pivot axis the period is decreased. Therefore, as mass is taken from the club head of a golf club and this mass is distributed along the shaft of a club the fractional decrease in the second moment I is greater than the fractional decrease in the first moment S. Redistribution of the mass of a golf club in this manner gives some control over the three matching parameters (I, S and M) in the design of a golf club.

To achieve an understanding of the techniques involved in designing a set of iron golf clubs matched in the new sense described by this invention, a club must first be selected and designated as the Master Club of the set. This Master Club is one of the shorter irons, probably a seven iron, and one which a prospective golfer has found by trial to be the ultimate for him in this particular number of club. The design process will determine the dynamic parameters of the other clubs of the set which are needed to exactly match each of these clubs to the Master Club. Clubs shorter than the master club are considered to be special clubs in the sense that golfers usually prefer these clubs to be designed with greater mass. Some manufacturers recognize these as special clubs in sets matched according to the swing-weight method.

Tentative clubs of the set, those longer than the Master Club, which are to be modified in the matching process, are temporarily assembled from club heads 16, connectors 24, grips 14, and shafts 12 of known characteristics to make a set of clubs of standard lengths. The latter three items are to be the same as would be used in the manufacture of the matched set of clubs. The three dynamic parameters of the Master Club and the other tenative clubs are then carefully determined. The total mass (M) of each club is determined by weighing the club, the club's first moment (S) is determined by the product of the club mass and the distance from the wristcock axis 22 to the center of mass of the club as measured along the shaft 12, and the club's second moment I is determined by finding the period of the club swung as a pendulum about the wristcock axis 22 and using the equation for the period of a physical pendulum giving the period in terms of the ratio of the first to a second moment about the axis:

$$I = \frac{gST^2}{4\pi^2}$$

The determination of these parameters for each of the assembled clubs removes the necessity of working with the parameters of the various elements of each club in the matching calculations.

In order to write equations involved in the matching of a set of golf clubs, it is necessary to have a notation descriptive of the various clubs. The subscript $_j$ designates the Master Club. The subscript $_i$ designates any other club to be matched to the Master Club. The subscript $_b$ indicates a parameter of a club before any modifications of the club in the matching process have been made. The subscript $_c$ indicates a parameter of a club after the matching process is completed. For example, $S_{bi}$ indicates the first moment of any club before matching, and $I_{cj}$ indicates the second moment of the Master Club after matching is completed. The shaft 12 of any club 10 serves as the x-axis in the following analysis.

In the matching process, clubs are matched by altering the mass located in the club head 16 of club i by an amount designated by the notation $A_i$ and by distributing an added mass $m_i$ along the shaft of club i. The added mass $m_i$ is shown in FIG. 1 as added mass 26. The mass distributed along the shaft of club i is described by the expression:

$$m_i = b\int f(x)dx$$

where x is a coordinate along the golf club shaft (x axis) with the origin at the wristcock axis (x=o), and where bf(x) is the linear mass density of the distribution. Here, b is a constant and f(x) is a function of x, continuous or discontinuous yet to be determined.

The mass $M_{ci}$, first moment $S_{ci}$, and the second moment $I_{ci}$, of club i after modification are:

$$M_{ci} = M_{bi} + A_i + m_i + \mu_i \quad (1)$$

$$S_{ci} = S_{bi} + A_iL_i + b\int xf(x)dx \quad (2)$$

$$I_{ci} = I_{bi} + A_i(L_i)^2 + b\int x^2f(x)dx \quad (3)$$

where $L_i$ is the coordinate of the center of mass of the club head of club i along the shaft (x axis). In FIG. 1, the relationship between the center of mass 28 of the club head 16, the coordinate 30 ($L_i$), and the shaft 12 is shown. Further mass $\mu_i$ is the mass placed in the shaft at x=o (the wristcock axis) and will have no effect on $S_{ci}$ or $I_{ci}$. Further mass 32 ($\mu_i$) is also shown in FIG. 1. The terms $A_iL_i$ and $A_i(L_i)^2$ are the contributions to the first and second moments, respectively, of any change in the club head mass, and the terms $b\int xf(x)dx$ and $b\int x^2f(x)dx$ are the contributions to the first and second moments, respectively, of any mass distributed along the shaft of a club.

For the clubs to be exactly matched in the new sense described in this patent, the following relations must hold for all values of the subscript $_i$:

$$M_{ci} = M_{cj} \quad (4)$$

$$S_{ci} = S_{cj} \quad (5)$$

$$I_{ci} = I_{cj} \quad (6)$$

Combining Equations 2 and 5 results in the following relationship:

$$S_{cj} = S_{bi} + A_iL_i + b\int xf(x)dx \quad (7)$$

Combining Equations 3 and 6 results in the following relationship:

$$I_{cj} = I_{bi} + A_i(L_i)^2 + b\int x^2f(x)dx \quad (8)$$

$A_i$ may be eliminated from Equations 7 and 8 with the following result:

$$b\int (L_ix - x^2)f(x)dx = L_i(S_{cj} - S_{bi}) - (I_{cj} - I_{bi}) = K_i \quad (9)$$

Notice that each of the expressions in Equation 9 is equal to a constant designated as $K_i$.

The mass $m_i$ distributed along the shaft is:

$$m_i = b\int f(x)dx = \frac{\int K_i f(x)dx}{\int (L_ix - x^2)f(x)dx} \quad (10)$$

This equation may be put in the form:

$$\int (L_ix - x^2 - K_i/m_i)f(x)dx = 0 \quad (11)$$

This integral is of great importance in the theory of matching clubs because it can be shown that through its use, for a given $K_i$, the minimum value of $m_i$ needed to match the first moments and the second moments of two clubs is $$m_i = \frac{4K_i}{(L_i)^2} = 4\left[\frac{L_i(S_{cj} - S_{bi}) - (I_{cj} - I_{bi})}{(L_i)^2}\right] \quad (12)$$

and that this mass must be placed at $x = L_i/2$. The function f(x) for this minimum value of $m_i$ is the Dirac delta function $\int (L_i/2 - x)$. Other functions f(x) may be used to match two clubs but the distributed mass $m_i$ will have to be larger than $4K_i/(L_i)^2$. The Dirac delta function is a unique function which provides a unique solution to the mass distribution integral. Other mass distribution functions could be used, but no other function would specify a smaller value for $m_i$.

Since the integral $b\int xf(x)dx$ is the first moment of the mass distribution along the shaft, when the added mass $m_i$ is placed at the point $L_i/2$, the midpoint between the wristcock axis and the coordinate along the shaft of the center of mass of the club head, the first moment of the added mass $m_i$ about this axis becomes simply $m_iL_i/2$. Equation 7 may then be written:

$$S_{cj}=S_{bi}+A_iL_i+m_iL_i/2 \tag{13}$$

Using equation 12, equation 13 may be put in the form:

$$A_i = \frac{2(I_{cj} - I_{bi})}{(L_i)^2} - \frac{(S_{cj} - S_{bi})}{L_i} \tag{14}$$

The mass $A_i$, calculated using equation 14, is that mass which must be added to the club head mass of the tentative club i to achieve the design club head mass. The added mass $m_i$, calculated using equation 12, is the mass that must be placed midway between the wristcock axis and the coordinate along the shaft of the center of mass of the club head of the tentative club i. The incorporation of masses $A_i$ and $m_i$ in a set of clubs insures that the clubs will be matched in the first moment and in the second moment. Theoretically, added mass $m_i$ is essentially a point mass and must be located at a particular geometric point. Calculations show, however, that the added mass $m_i$ can be spread over some length along the shaft with its center of mass located at $x=L_i/2$ with negligible error.

The matched set of clubs has one club of greatest mass. The other clubs of the set, including the Master Club, are adjusted to this club of greatest mass by putting a further mass $\mu_i$ in the shaft adjacent the wristcock axis of the tentative club i and a further mass $\mu_j$ in the shaft adjacent the wristcock axis of the Master Club. These further masses $\mu_i$ and $\mu_j$ insure that the masses of the clubs of the set will be identical without affecting the other two dynamic parameters (S and I). The further mass $\mu_j$ to be placed in the shaft adjacent the wristcock axis of the Master Club is seen to be uniquely determined by the theory here presented as to its mass and position.

In the practical application of this method of matching clubs there may be no need to have exact matching. The requirement of exact matching may be relaxed in a controlled manner by any predetermined amount of replacing Equations 4, 5, and 6 with the following relationships:

$$M_{ci}=(1+r_i)M_{cj} \tag{15}$$

$$S_{ci}=(1+q_i)S_{cj} \tag{16}$$

$$I_{ci}=(1+p_i)I_{cj} \tag{17}$$

where $p_iq_i$, and $r_i$ are positive or negative quantities. For example, when $p=-q=0.005$, $I_{ci}$ will be one-half percent larger than $I_{cj}$, and $S_{ci}$ will be one-half percent smaller than $S_{cj}$.

When Equations 15, 16, and 17 are used instead of Equations 4, 5, and 6, the theory is developed as before with Equations 12 and 14 taking the forms:

$$m_i = 4\left[\frac{L_i([1 + q_i]S_{cj} - S_{bi}) - ([1 + p_i]I_{cj} - I_{bi})}{(L_i)^2}\right] \tag{18}$$

$$A_i = \frac{2([1 + p_i]I_{cj} - I_{bi})}{(L_i)^2} - \frac{([I + q_i]S_{cj} - S_{bi})}{L_i} \tag{19}$$

It should be emphasized that when the requirement of exact matching is relaxed, the process of matching a set of clubs proceeds exactly as before. For each club an added mass $m_i$ is placed at $x=L_i/2$ and a suitable mass $\mu_i$ is placed at $x=o$ so that Equation 15 is satisfied. The values of $p_i$, $q_i$, and $r_i$ may vary from club to club.

Judicial relaxation using the relaxing factors, $p_i$, $q_i$, and $r_i$, to match the dynamic parameters of a set of clubs can produce a variation from perfect matching detectible by perhaps only the most sensitive golfer. In all likelihood, the only way to tell such a set of clubs was not matched to mathematical perfection would be by use of delicate instrumentation.

EXAMPLES

The best way to illustrate the application of the matching scheme described by this invention is by example. The golf clubs involved in the following examples were a professional quality set of clubs of standard lengths originally matched by the swing-weight method. The clubs are a set of irons manufactured by P.G.A. Victor under the name of Tommy Armour, having "True Tempered Dynamic" stiff shafts. This particular set of clubs was chosen for experimentation and analysis because the clubs were carefully swing-weight matched and the set included the number one iron. The number seven iron was chosen as the Master Club. The longer irons were taken as the tentative clubs for the matching process. The number eight iron, the number nine iron, and the pitching wedge were considered to be specialty clubs and, therefore, were not included in examples of dynamically matched sets.

The relative parameters for each club of the set were determined empirically. The first moment S, and the second moment I, of each club were determined about a wristcock axis 22 located five inches from the grip end of the club. The positioning of the wristcock axis 22 relative to the grip end of the club is illustrated in FIG. 1 as distance d. For purposes of these examples, d=5 inches. The mass M and the distance L from the wristcock axis 22 to the coordinate 30 of the center of mass of the club head 16 along the shaft 12 were also determined for each club. All measurements and calculations were performed in the cgs (centimeter gram second) system of units. The values of these four parameters, $L_i$, $I_i$, $S_i$ and $M_i$, are shown in Table I.

TABLE I

| Club No. | 1 | 2 | 3 | 4 |
|---|---|---|---|---|
| $L_i$ | 87.1 | 85.8 | 84.6 | 83.3 |
| $I_i$ | 2051000 | 2040000 | 2025000 | 2006000 |
| $S_i$ | 25090 | 25240 | 25390 | 25580 |
| $M_i$ | 421.8 | 427.2 | 429.7 | 440.3 |

| Club No. | 5 | 6 | 7 |
|---|---|---|---|
| $L_i$ | 82.2 | 81.0 | 79.8 |
| $I_i$ | 1993000 | 1986000 | 1970000 |
| $S_i$ | 25650 | 25890 | 25950 |
| $M_i$ | 441.6 | 452.1 | 456.9 |

Pitching

TABLE I-continued

| Club No. | 8 | 9 | Wedge |
|---|---|---|---|
| $L_i$ | 79.4 | 78.4 | 77.5 |
| $I_i$ | 1959000 | 1970000 | 1991000 |
| $S_i$ | 26040 | 26570 | 27150 |
| $M_i$ | 457.7 | 485.1 | 481.6 |

Figure 3:
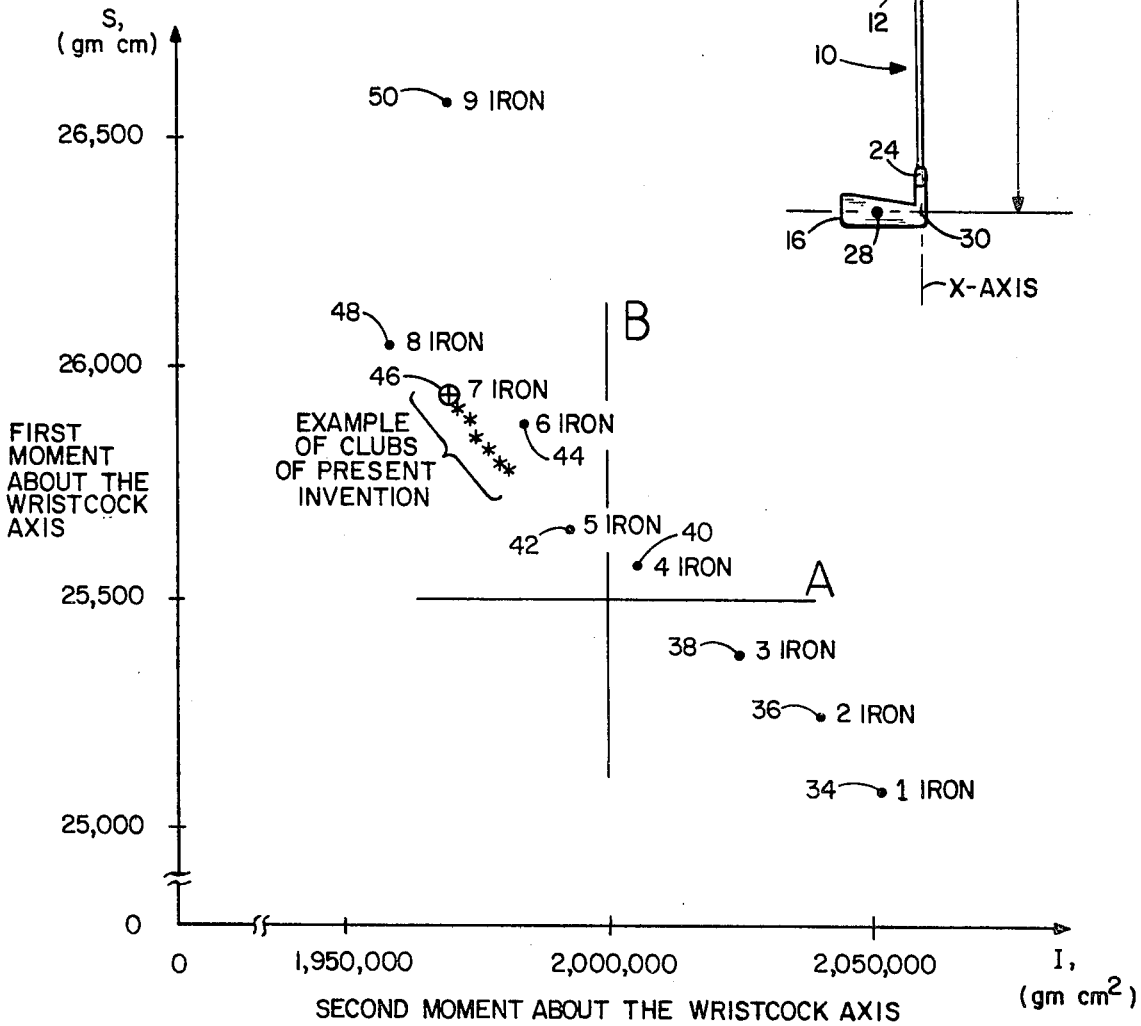
FIG. 3 illustrates the relationships between the first and second moments about wristcock axes for golf clubs of various parameters.

In order to further illustrate the different methods of matching gold clubs, the relationships between the first moment S and the second moment I of the set of clubs of Table I are shown in FIG. 3. These parameters (I and S) for each club of the set listed in Table I are plotted in FIG. 3. Reference character 34 represents the number one iron, reference character 36 represents the number two iron, reference character 38 represents the number three iron, reference character 40 represents the number four iron, reference character 42 represents the number five iron, reference character 44 represents the number six iron, reference character 46 represents the number seven iron, reference character number 48 represents the number eight iron and reference character 50 represents the number nine iron. These values from Table I, of course, represent the relationship between the first moment and second moment of a set of clubs matched according to the swing-weight method. A set of clubs matched merely according to their first moments about some wristcock axis would lie along a horizontal line such as line A shown in FIG. 3. A set of clubs matched simply according to their second moment about some wristcock axis would lie along a vertical line in FIG. 3, illustrated by line B.

EXAMPLE I

In this example of matching, the number one through number six irons are perfectly matched to the number seven iron, the Master Club. The results of the matching calculations using the Equations 1, 4, 12 and 14 and the club parameters listed in Table I are shown in Table II and illustrated in FIG. 4.

TABLE II

| Club No. | 1 | 2 | 3 | 4 |
|---|---|---|---|---|
| $L_i$ | 87.1 | 85.8 | 84.6 | 83.3 |
| $I_i$ | 1970000 | 1970000 | 1970000 | 1970000 |
| $S_i$ | 25950 | 25950 | 25950 | 25950 |
| $M_i$ | 472.8 | 472.8 | 472.8 | 472.8 |
| $A_i$ | −31.2 | −27.3 | −22.0 | −14.8 |
| $m_i$ | 82.2 | 71.1 | 57.2 | 38.5 |
| $\mu_i$ | 0 | 1.8 | 7.9 | 8.8 |

| Club No. | 5 | 6 | 7 (Master Club) |
|---|---|---|---|
| $L_i$ | 82.2 | 81.0 | 79.8 |
| $I_i$ | 1970000 | 1970000 | 1970000 |
| $S_i$ | 25959 | 25950 | 25950 |
| $M_i$ | 472.8 | 472.8 | 472.8 |
| $A_i$ | −10.4 | −5.6 | 0 |
| $m_i$ | 28.2 | 12.7 | 0 |
| $\mu_i$ | 13.4 | 13.6 | 15.9 ($\mu_j$) |

For example, the number one iron is matched with the Master club (seven iron) in the following manner:

$L_i = L_1 = 87.1$ cm
$M_{bi} = M_{b1} = 421.8$ gm
$S_{bi} = S_{b1} = 25090$ gm cm
$I_{bi} = I_{b1} = 2051000$ gm cm$^2$
$M_{bj} = M_{b7} = 456.9$ gm
$S_{cj} = S_{c7} = 25950$ gm cm
$I_{cj} = I_{c7} = 1970000$ gm cm$^2$

From Equation 12:

-continued $$m_i = m_1 = 4\left[\frac{L_1(S_{c7} - S_{b1}) - (I_{c7} - I_{b1})}{(L_1)^2}\right] \text{(gm)}$$

$$= 4\left[\frac{87.1(25950 - 25090) - (1970000 - 2051000)}{(87.1)^2}\right] \text{(gm)}$$

$m_1 = 82.2$ gm

From Equation 14:

$$A_i = A_1 = \frac{2(I_{c7} - I_{b1})}{(L_1)^2} - \frac{(S_{c7} - S_{b1})}{L_1} \text{(gm)}$$

$$= \frac{2(1970000 - 2051000)}{(87.1)^2} - \frac{(25950 - 25090)}{87.1} \text{(gm)}$$

$A_1 = -31.2$ gm

To achieve matching between the number one iron and the Master Club, an added mass of $m_1 = 82.2$ gm must be rigidly distributed in the shaft of the one iron midway between the wristcock axis and the coordinate along the shaft of the center of mass of the club head. The positioning of such an added mass 26 is shown in FIG. 1 at a distance $L_i/2$ from the wristcock axis 22. In this example, $L_1/2 = 87.1/2$ cm $= 43.55$ cm.

In addition, a further mass of $A_1 = 31.2$ gm must be removed from the mass of the club head of the number one iron in order to achieve perfect matching. The total mass of the number one iron after matching is found using Equation 1:

$$M_{ci} = M_{bi} + A_i + m_i + \mu_i \text{(gm)}$$

$$M_{c1} = M_{b1} + A_1 + m_1 + \mu_1 \text{(gm)}$$

$$= 421.8 + (-31.2) + 82.2 + 0.0 \text{ (gm)}$$

$M_{c1} = 472.8$ gm

Figure 4:
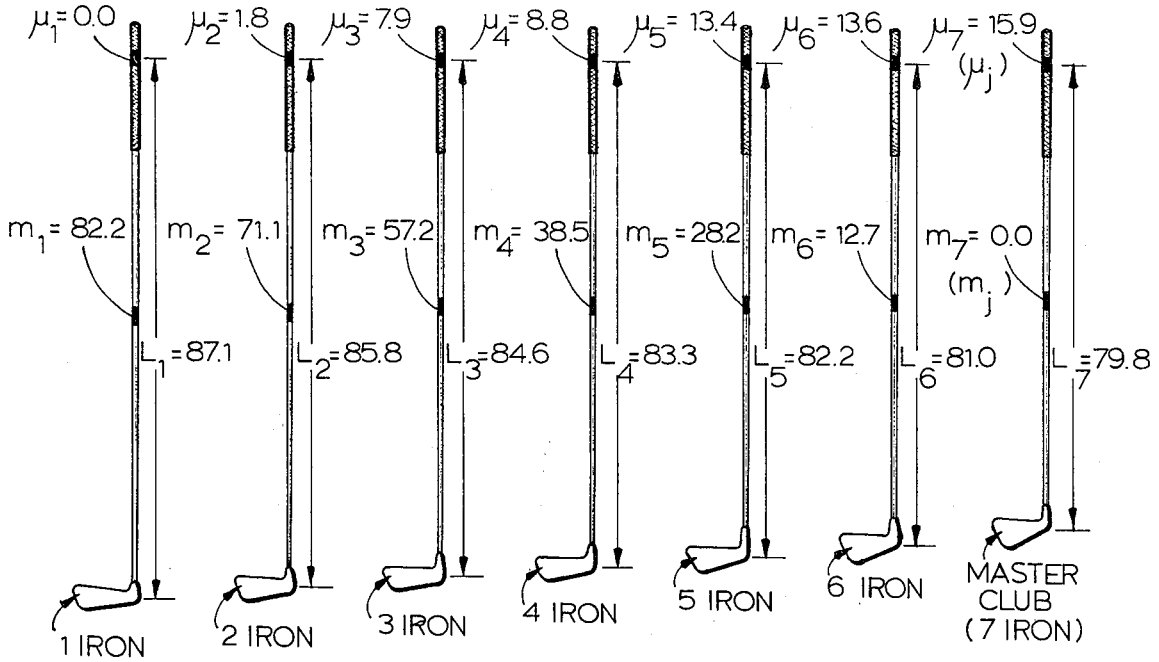
FIG. 4 illustrates a correlated set of golf clubs having parameters as designed in Table II of this specification.

Since the number one iron is the club of greatest mass in the set, no further mass $\mu_1$ need be added to it at the wristcock axis, i.e., $\mu_1 = 0.0$ (see FIG. 4). However, to achieve perfect matching between the set of clubs, a further mass $\mu_j$ must be placed in the Master Club to match it to the mass of the number one iron as per Equation 4. Using Equations 1 and 4, the further mass $\mu_j$ may be determined:

$$M_{cj} = M_{ci} \text{ (gm)}$$

$$M_{c7} = M_{cl} \text{ (gm)}$$

$$M_{c7} = 472.8 \text{ (gm)}$$

$$M_{cj} = M_{bj} + A_j + m_j = \mu_j \text{ (gm)}$$

$$M_{c7} = M_{b7} + A_7 + m_7 + \mu_7 \text{ (gm}$$

$$472.8 = 456.9 + 0.0 + 0.0 + \mu_7 \text{ (gm)}$$

Solving for $\mu_7$:

$$\mu_7 = 472.8 - 456.9 \text{ (gm)}$$

$$\mu_7 = 15.9 \text{ gm}$$

Therefore, a further mass of $\mu_7=15.9$ gm must be rigidly distributed in the shaft of the Master Club adjacent the wristcock axis. The positioning of such a further mass 32 is shown in FIG. 1 adjacent the wristcock axis 22 and is generally illustrated in FIG. 4.

The matching of the other clubs of the set to the Master Club proceeds in the same manner to achieve the parameters described in Table II. After determining the values for $m_i$ and $A_i$ for each club, appropriate further masses $\mu_i$ must be placed adjacent the wristcock axis of each club to bring the total mass of the club to the 472.8 gm mass of the Master Club. The clubs so matched have identical masses, identical first moments about their wristcock axes, and identical second moments about their wristcock axes. The relationship of the values of the first and second moments of these perfectly matched clubs is shown by the symbol ⊕ in FIG. 3, which, of course, corresponds to the parameters of the set of clubs described in Table II and illustrated in FIG. 4. The club lengths of this dynamically perfect matched set of clubs are the same standard lengths as those of the original swing-weight set of clubs of Table I.

EXAMPLE II

In this second example of matching, the number one through number six irons are again matched to the Master Club (seven iron), but not to mathematical perfection. Rather, the matching of the first and second moments is relaxed by successively increasing amounts from the number six iron at 0.1 percent to the number one iron at 0.6 percent, as shown in Table III and illustrated in FIG. 5. This relaxed matching is achieved by incorporated the $p_i$ and $q_i$ values into the matching formulations. In this example, $p_i$ and $q_i$ are in each case kept equal in magnitude but opposite in sign. The matching calculations proceed as explained in Example I except that Equations 18 and 19 are now used to determine the values of the added mass and further mass respectively. As in Example I, the matching process is begun using the club parameters of a standard set of swing-weight matched clubs as described in Table I. The club parameters resulting from this relaxed matching are described in Table III and illustrated in FIG. 5.

TABLE III

| Club No. | 1 | 2 | 3 | 4 |
|---|---|---|---|---|
| $L_i$ | 87.1 | 85.8 | 84.6 | 83.3 |
| $I_i$ | 1982000 | 1980000 | 1978000 | 1976000 |
| $S_i$ | 25790 | 25820 | 25850 | 25870 |
| $M_i$ | 464.3 | 464.3 | 464.3 | 464.3 |
| $A_i$ | −26.3 | −23.1 | −18.6 | −12.2 |
| $m_i$ | 68.8 | 59.7 | 47.9 | 31.4 |
| $\mu_i$ | 0 | 0.1 | 5.3 | 4.8 |
| $p_i$ | .006 | .005 | .004 | .003 |
| $q_i$ | −.006 | −.005 | −.004 | −.003 |
| $r_i$ | 0 | 0 | 0 | 0 |

| Club No. | 5 | 6 | 7 (Master Club) |
|---|---|---|---|
| $L_i$ | 82.2 | 81.0 | 79.8 |
| $I_i$ | 1974000 | 1972000 | 1970000 |
| $S_i$ | 25900 | 25920 | 25950 |
| $M_i$ | 464.3 | 464.3 | 464.3 |
| $A_i$ | −8.6 | −4.7 | 0 |
| $m_i$ | 23.3 | 10.2 | 0 |
| $\mu_i$ | 8.0 | 6.7 | 7.4 ($\mu_j$) |
| $p_i$ | .002 | .001 | 0 |
| $q_i$ | −.002 | −.001 | 0 |
| $r_i$ | 0 | 0 | 0 |

Figure 5:
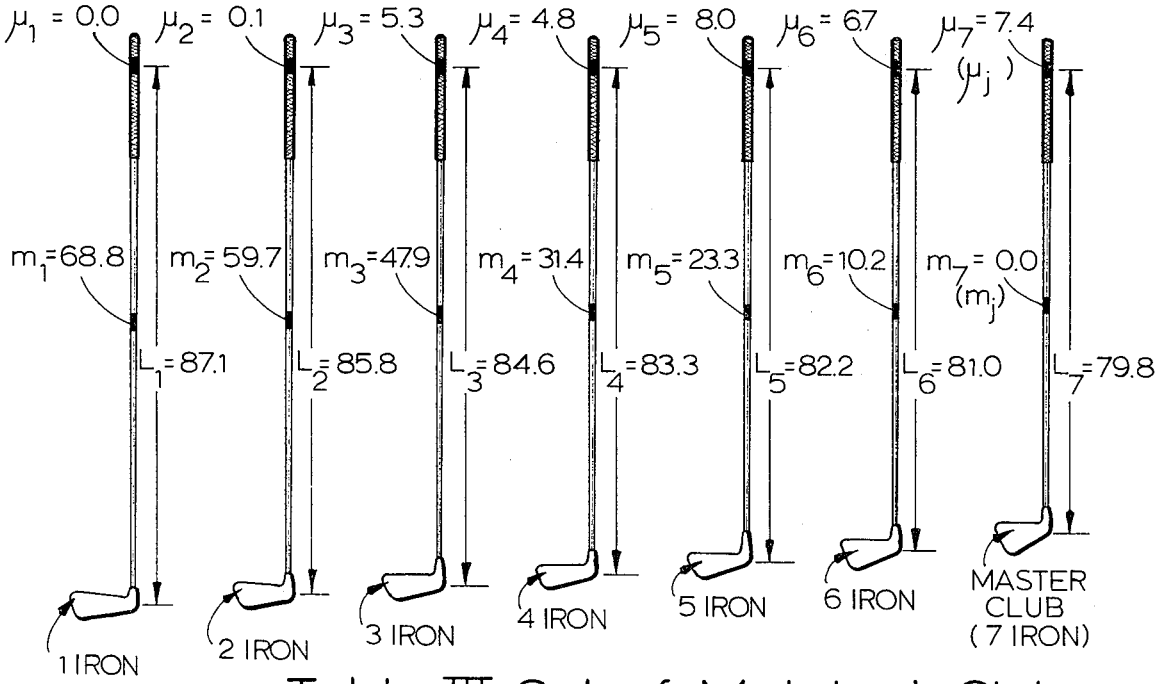
FIG. 5 illustrates a correlated set of golf clubs having parameters as designed in Table III of this specification.

The relationships of the values of the first and second moments of these relaxed-matching clubs are shown by the symbols * in FIG. 3, which, of course, correspond to the parameters of the set of clubs described in Table III and illustrated in FIG. 5. As can be seen in Table III, the masses of each club in this set are identical in this example, being fixed at a value of 464.3 gm. It is also apparent from a comparison of the first and second moments of the clubs in Table III that the first and second moment values fro each club are within fifteen one-hundredths of a percent (0.15%) of the respective moments of each adjacent club in the matched set.

To further illustrate the relaxed-matching, the calculations required to match the number one iron with the Master Club are shown below.

$L_i = L_1 = 87.1$ cm
$M_{bi} = M_{b1} = 421.8$ gm
$S_{bi} = S_{b1} = 25090$ gm cm
$I_{bi} = I_{b1} = 2051000$ gm cm$^2$
$p_i = .006$
$q_i = -.006$
$r_i = 0.0$
$M_{bj} = M_{b7} = 456.9$ gm
$S_{cj} = S_{c7} = 25950$ gm cm
$I_{cj} = I_{c7} = 1970000$ gm cm$^2$

From Equation 18:

$$m_i = m_1 = 4\left[\frac{L_1([1+q_1]S_{c7} - S_{b1})}{(L_1)^2} - \frac{([1+p_1]I_{c7} - I_{b1})}{(L_1)^2}\right] \text{(gm)}$$

$$= 4\left[\frac{87.1([1-.006]25950 - 25090)}{(87.1)^2} - \frac{([1+.006]1970000 - 2051000)}{(87.1)^2}\right] \text{(gm)}$$

$m_1 = 68.8$ gm

From Equation 19:

$$A_i = A_1 = \frac{2([1+p_1]I_{c7} - I_{b1})}{(L_1)^2} - \frac{([1+q_1]S_{c7} - S_{b1})}{L_1} \text{(gm)}$$

$$= \frac{2([1+.006]1970000 - 2051000)}{(87.1)^2} - \frac{([1-.006]25950 - 25090)}{87.1} \text{(gm)}$$

$A_1 = -26.3$ gm

The added mass of $m_1=68.8$ gm must be rigidly distributed in the shaft of the one iron midway between the wristcock axis and the coordinate along the shaft of the center of mass of the club head. The positioning of such an added mass 26 is shown in FIG. 1 at a distance $L_i/2$ from the wristcock axis 22. In this case, $L_1/2=87.1/2$ cm=43.55 cm.

In addition, a further mass of $A_1=26.3$ gm must be removed from the mass of the club head of the number one iron. The total mass of the number one iron after matching is found using Equation 1:

$$M_{ci} = M_{bi} + A_i = m_i + \mu_i \text{ (gm)}$$

$$M_{c1} = M_{b1} + A_1 + m_1 + \mu_1 \text{ (gm)}$$

$$= 421.8 + (-26.3) + 68.8 + 0.0 \text{ (gm)}$$

$$M_{c1} = 464.3 \text{ gm}$$

Since the number one iron is the club of greatest mass in the set, no further mass $\mu_1$ need be added to it at the wristcock axis, i.e., $\mu_1=0.0$ (see FIG. 5). However, since the matching of the total masses of the clubs has not been relaxed in this example, a further mass $\mu_j$ must be placed in the Master Club to match it to the mass of the number one iron as per Equation 4. Using Equations 1 and 4, the further mass $\mu_j$ may be determined:

$$M_{cj}=M_{ci} \text{ (gm)}$$

$$M_{c7}=M_{c1} \text{ (gm)}$$

$$M_{c7}=464.3 \text{ gm}$$

$$M_{cj}=M_{bj}+A_j+m_j+\mu_j \text{ (gm)}$$

$$M_{c7}=M_{b7}+A_7+m_7+\mu_7 \text{ (gm)}$$

$$464.3=456.9+0.0+0.0+\mu_7 \text{ (gm)}$$

Solving for $\mu_7$:

$$\mu_7=464.3-456.9 \text{ (gm)}$$

$$\mu_7=7.4 \text{ gm}$$

Therefore, a further mass of $\mu_7=7.4$ gm must be rigidly distributed in the shaft of the Master Club adjacent the wristcock axis. The positioning of such a further mass 32 is shown in FIG. 1 adjacent the wristcock axis 22 and is generally illustrated in FIG. 5.

The matching of the other clubs of the set to the Master Club proceeds in the same manner to achieve the parameters described in Table III. After determining the values for $m_i$ and $A_i$ for each club, appropriate further masses $\mu_i$ must be placed adjacent the wristcock axis of each club to bring the total mass of the club to the 464.3 gm mass of the Master Club.

As may be seen from a comparison of the total masses ($M_i$) of the clubs in Tables II and III, the mass of each of the relaxed-matching clubs of Example II and Table III is 8.5 gm less than that of the corresponding clubs of Table II of Example I, which represents a perfectly matched set of clubs. In other words, by relaxing the first and second moment parameters by a very small margin (the $p_i$ and $q_i$ factors) a lighter set of clubs overall may be attained. For this reason, the judicial relaxation from perfect matching shown in Example II may be useful in the design of a matched set of clubs where the relaxation from perfect matching is undetectable except when the club parameters are measured by the use of instruments.

The values of $p_i$ and $q_i$ used in this example are such that the difference of the first moment and second moment parameters between any two clubs in a relaxed-matched set is small enough so that the difference in the feel of the clubs would be undetectable by even the most sensitive golfer. It is found by calculation that the mass $\mu_j$ of the slug to be placed in the shaft adjacent the wristcock axis of the Master Club increases linearly with the increase of $p_i$ and $q_i$, and the total mass of each club of the set becomes smaller as the value of $p_i$ and $q_i$ for the number one iron is increased. The masses $A_i$ and $m_i$ follow the same trend. For clubs matched according to the swing-weight method, the feel of the number one iron and the feel of the number seven iron during the golf swing are noticeably different. The application of this relaxed-matching method which produces a set of clubs with parameters as shown in Table III and illustrated in FIG. 5 should find its most useful application in the production of clubs where the values of $p_i$, $q_i$, and $r_i$, are just outside the limits of detectability by a sensitive golfer. In this example, $r_i=0.0$ and $p_i=-q_i$, but it should be understood that the values of $p_i$, $q_i$, and $r_i$, are not limited to these conditions.

The examples of matching a set of gold clubs as described in this patent only illustrate the matching of a set of irons. It should be recognized, however, that this matching method is equally applicable to the wood clubs of a set as well.

Although the present invention has been described with reference to preferred embodiments, workers skilled in the art will recognize that changes may be made in form and detail without departing from the spirit and scope of the invention.

What is claimed is:

1. A correlated set of more than two golf clubs in which the golf clubs have different lengths and each has a shaft representing an x axis with a grip having a preselected wristcock axis at one end and a club head having a center of mass at the other end, one of said clubs being selected as a master club having the desired characteristics for the golfer and all of the clubs but the master club having an added mass rigidly secured to the golf club at a point one half the distance between the wristcock axis of the grip and the center of mass of the clubhead, each of the clubs having the same overall mass despite their difference in length, the mass of the club head and the mass of the added mass rigidly secured at the midpoint being so computed that the first moment of each club in the correlated set is within fifteen one-hundredths of a percent (0.15%) of the first moment of each adjacent club in the set and the second moment of each club in the correlated set is within fifteen one-hundredths of a percent (0.15%) of the second moment of each adjacent club in the set, with the first and second moments of each club being measured about said wristcock axis.

2. The set of clubs of claim 1 in which the remaining clubs are correlated with said master club by adjustment of the values of the mass of the club head and the mass of the added mass of each of said remaining clubs.

3. The set of clubs of claim 2 in which a further mass is disposed in each of the clubs adjacent the wristcock axis and in which the values of the further mass, the added mass and the mass of the club head of each of the clubs are computed so as to provide for the same overall mass, the same first moment about the wristcock axis and the same second moment about said wristcock axis.

4. The set of clubs of claim 3 in which the relationship between the various masses is represented by the equation, $$M_{ci}-M_{bi}=A_i+m_i+\mu_i$$

where $\mu_i$ is the mass of the further mass disposed in club i at x=0, $$\mu_i = M_{ci} - M_{bi} - A_i - m_i$$

$M_{ci}$ is the total mass of club i after matching,
$M_{bi}$ is the total mass of club i before matching,
$A_i$ is the change in mass of club i at $x = L_i$, $$A_i = \frac{2(I_{cj} - I_{bi})}{L_i^2} - \frac{(S_{cj} - S_{bi})}{L_i}$$

$m_i$ is the mass of the added mass secured in club i at $x = L_i/2$, $$m_i = 4\left[\frac{L_i(S_{cj} - S_{bj}) - (I_{cj} - I_{bi})}{(L_i)^2}\right]$$

$I_{cj}$ is the second moment of the master club j after matching, $$I_{cj} = \frac{gS_{cj}(T_{cj})^2}{4\pi^2}$$

$T_{cj}$ is the period of a physical pendulum of the master club j measured about the wristcock axis of master club j (x=0) after matching
g is the acceleration due to gravity,
$S_{cj}$ is the first moment of the master club j after matching, $$S_{cj} = M_{cj}D_{cj}$$

$M_{cj}$ is the total mass of the master club j after matching,
$D_{cj}$ is the distance from the wristcock axis (x=0) to the center of mass of the master club j along the shaft (x axis) after matching,
$I_{bi}$ is the second moment of club i before matching $$I_{bi} = gS_{bi}(T_{bi})^2$$

4 2

$T_{bi}$ is the period of a physical pendulum of club i measured about the wristcock axis of club i (x=0) before matching,
$S_{bi}$ is the first moment of club i before matching $$S_{bi} = M_{bi}D_{bi}$$

$D_{bi}$ is the distance from the wristcock axis (x=0) to the center of mass of club i along the shaft (x axis) before matching,
$L_i$ is the coordinate of the center of mass of the club head of club i along the shaft (x axis).

5. The set of clubs of claim 2 in which a further mass is disposed in each of the clubs adjacent the wristcock axis and in which the mass of the further mass, the mass of the added mass and the mass of the club head of each of the clubs are computed so as to provide the same overall mass and so that the first moment and second moment for each club in the correlated set are within fifteen one-hundredths of a percent (0.15%) of the respective moments of each adjacent club in the set.

6. The set of clubs of claim 5 in which the relationship between the various masses is represented by the equation $$M_{ci} - M_{bi} = A_i + m_i + \mu_i$$

where $$\mu_i = M_{ci} - M_{bi} - A_i - m_i$$

$M_{ci}$ is the total mass of club i after matching,
$M_{bi}$ is the total mass of club i before matching,
$A_i$ is the change in mass of club i at $x = L_i$ $$A_i = \frac{2([1 + p_i]I_{cj} - I_{bi})}{(L_i)^2} - \frac{([1 + q_i]S_{cj} - S_{bi})}{L_i}$$

$m_i$ is the mass of the added mass secured in club i at $x = L_i/2$, $$m_i = 4\left[\frac{L_i([1 + q_i]S_{cj} - S_{bi}) - ([1 + p_i]I_{cj} - I_{bi})}{(L_i)^2}\right]$$

$I_{cj}$ is the second moment of the master club j after matching, $$I_{cj} = \frac{gS_{cj}(T_{cj})^2}{4\pi^2}$$

$T_{cj}$ is the period of a physical pendulum of the master club j measured about the wristcock axis of master club j (x=0) after matching,
g is the acceleration due to gravity,
$S_{cj}$ is the first moment of the master club j after matching, $$S_{cj} = M_{cj}D_{cj}$$

$M_{cj}$ is the total mass of the master club j after matching,
$D_{cj}$ is the distance from the wristcock axis (x=0) to the center of mass of the master club j along the shaft (x axis) after matching,
$I_{bi}$ is the second moment of club i before matching, $$I_{bi} = \frac{gS_{bi}(T_{bi})^2}{4\pi^2}$$

$T_{bi}$ is the period of a physical pendulum of club i measured about the wristcock axis of club i (x=0) before matching,
$S_{bi}$ is the first moment of club i before matching, $$S_{bi} = M_{bi}D_{bi}$$

$D_{bi}$ is the distance from the wristcock axis (x=0) to the center of mass of club i along the shaft (x axis) before matching,
$L_i$ is the coordinate of the center of mass of the club head of club i along the shaft (x axis), $$M_{ci} = (1 + r_i)M_{cj}$$

$$S_{ci} = (1 + q_i)S_{cj}$$

$$I_{ci} = (1 + p_i)I_{cj}$$

$r_i$ is a relaxing factor for total mass,
$q_i$ is a relaxing factor for first moment, $p_i$ is a relaxing factor for second moment.

7. The set of clubs of claim 6 in which relaxing factors $r_i$, $q_i$, and $p_i$ are so selected such that $\mu_i=0.0$.

8. A method for producing a correlated set of a plurality of golf clubs having differing lengths, each club having a shaft representing an x axis with a grip having a preselected wristcock axis at one end and a club head having a center of mass at the other end, all of the clubs having a desirably similar dynamic feel for a particular golfer, including the steps of (a) determining the desired dynamic characteristics for the golfer, (b) selecting one club of the set as a master club having said desired characteristics, (c) fashioning all of the clubs but the master club with an added mass rigidly secured to each club at a point one half the distance between the wristcock axis of the grip and the center of mass of the club head, and (d) computing for each club the mass of the club head and mass of the added mass rigidly secured at the midpoint so that each of the clubs, despite their difference in length, has substantially the same overall mass and so that the first moment about said wristcock axis and second moment about said wristcock axis for each club in the correlated set are within fifteen one-hundredths of a percent (0.15%) of the respective moments of each adjacent club in the set.

9. The method of claim 8 in which there is provided the further step of correlating the remaining clubs of the set with said master club by adjustment of the values of the mass of the club head and the mass of the added mass in each of said remaining clubs.

10. The method of claim 9 in which there is provided the further steps of (a) disposing a further mass in each of the clubs adjacent the wristcock axis, and (b) computing for each club the mass of the further mass, the mass of the club head, and the mass of the added mass rigidly secured at the midpoint so that each of the clubs despite their difference in length, has substantially the same overall mass and the first moment about said wristcock axis and second moment about said wristcock axis for each club in the correlated set are within fifteen one-hundredths of a percent (0.15%) of the respective moments of each adjacent club in the set.

11. The method of claim 10 in which there is provided the further step of defining the relationship between the various masses by the equation $$M_{ci}-M_{bi}=A_i+m_i+\mu_i$$

where $$_i=M_{ci}-M_{bi}-A_i-m_i$$

$M_{ci}$ is the total mass of club i after matching, $M_{bi}$ is the total mass of club i before matching, $A_i$ is the change in mass of club i at $x=L_i$ $$A_i=\frac{2([1+p_i]I_{cj}-I_{bi})}{(L_i)^2}-\frac{([1+q_i]S_{cj}-S_{bi})}{L_i}$$

$m_i$ is the mass of the added mass secured in club i at $x=L_i/2$, $$m_i=4\left[\frac{L_i([1+q_i]S_{cj}-S_{bi})-([1+p_i]I_{cj}-I_{bi})}{(L_i)^2}\right]$$

$I_{cj}$ is the second moment of the master club j after matching, $$I_{cj}=\frac{gS_{cj}(T_{cj})^2}{4\pi^2}$$

$T_{cj}$ is the period of a physical pendulum of the master club j measured about the wristcock axis of master club j (x=0) after matching, g is the acceleration due to gravity, $S_{cj}$ is the first moment of the master club j after matching, $$S_{cj}=M_{cj}D_{cj}$$

$M_{cj}$ is the total mass of the master club j after matching, $D_{cj}$ is the distance from the wristcock axis (x=0) to the center of mass of the master club j along the shaft (x axis) after matching, $I_{bi}$ is the second moment of club i before matching, $$I_{bi}=\frac{gS_{bi}(T_{bi})^2}{4\pi^2}$$

$T_{bi}$ is the period of a physical pendulum of club i measured about the wristcock axis of club i (x=0) before matching, $S_{bi}$ is the first moment of club i before matching, $$S_{bi}=M_{bi}D_{bi}$$

$D_{bi}$ is the distance from the wristcock axis (x=0) to the center of mass of club i along the shaft (x axis) before matching, $L_i$ is the coordinate of the center of mass of the club head of club i along the shaft (x axis), $$M_{ci}=(1+r_i)M_{cj}$$

$$S_{ci}=(1+q_i)S_{cj}$$

$$I_{ci}=(1+p_i)I_{cj}$$

$r_i$ is a relaxing factor for total mass, $q_i$ is a relaxing factor for first moment, $p_i$ is a relaxing factor for second moment.

12. The method of claim 11 in which there is provided the further step of selecting the values for the relaxing factors $r_i$, $q_i$, and $p_i$ such that $\mu_i=0.0$.

13. The method of claim 9 in which there is provided the further steps of (a) disposing a further mass in each of the clubs adjacent the wristcock axis, and (b) computing for each club the mass of the further mass, the mass of the club head, and the mass of the added mass rigidly secured at the midpoint so that each of the clubs, despite their difference in length, has the same overall mass, the same first moment about the wristcock axis, and the same second moment about said wristcock axis.

14. The method of claim 13 in which there is provided the further step of defining the relationship between the various masses by the equation $$M_{ci}-M_{bi}=A_i+m_i+\mu_i$$

where $\mu_i$ is the mass of the further mass disposed in club i at x=0, $$\mu_i=M_{ci}-M_{bi}-A_i-m_i,$$

$M_{ci}$ is the total mass of club i after matching, $M_{bi}$ is the total mass of club i before matching, $A_i$ is the change in mass of club i at $x=L_i$ $$A_i=\frac{2(I_{cj}-I_{bi})}{(L_1)^2}-\frac{(S_{cj}-S_{bi})}{L_i}$$

$m_i$ is the mass of the added mass secured in club i at $x=L_i/2$, $$m_i=4\left[\frac{L_i(S_{cj}-S_{bj})-(I_{cj}-I_{bi})}{(L_i)^2}\right]$$

$S_{cj}$ is the second moment of the master club j after matching, $$I_{cj}=\frac{gS_{cj}(T_{cj})^2}{4\pi^2}$$

$T_{cj}$ is the period of a physical pendulum of the master club j measured about the wristcock axis of master club j (x=0) after matching g is the acceleration due to gravity, $S_{cj}$ is the first moment of the master club j after matching, $$S_{cj}=M_{cj}D_{cj}$$

$M_{cj}$ is the total mass of the master club j after matching, $D_{cj}$ is the distance from the wristcock axis (x=0) to the center of mass of the master club j along the shaft (x axis) after matching, $I_{bi}$ is the second moment of club i before matching $$I_{bi}=\frac{gS_{bi}(T_{bi})^2}{4\pi^2}$$

$T_{bi}$ is the period of a physical pendulum of club i measured about the wristcock axis of club i (x=0) before matching, $S_{bi}$ is the first moment of club i before matching, $$S_{bi}=M_{bi}D_{bi}$$

$D_{bi}$ is the distance from the wristcock axis (x=0) to the center of mass of club i along the shaft (x axis) before matching, $L_i$ is the coordinate of the center of mass of the club head of club i along the shaft (x axis).

* * * * *